United States Patent [19]

Yamazaki et al.

[11] Patent Number: 4,859,554

[45] Date of Patent: Aug. 22, 1989

[54] MULTILAYER PHOTORECEPTOR

[75] Inventors: Toshinori Yamazaki; Eiichi Sakai; Tatsuo Nakanishi; Hiroyuki Nomori, all of Hachioji, Japan

[73] Assignee: Konishiroku Photo Industry Co., Ltd., Tokyo, Japan

[21] Appl. No.: 175,583

[22] Filed: Mar. 28, 1988

Related U.S. Application Data

[63] Continuation of Ser. No. 910,242, Sep. 18, 1986, abandoned, Continuation-in-part of Ser. No. 867,415, May 15, 1986, abandoned, which is a continuation of Ser. No. 716,190, Mar. 26, 1985, abandoned.

[30] Foreign Application Priority Data

| | | | |
|---|---|---|---|
| Mar. 28, 1984 | [JP] | Japan | 59-59728 |
| Mar. 28, 1984 | [JP] | Japan | 59-59729 |
| Mar. 28, 1984 | [JP] | Japan | 59-59730 |
| Mar. 28, 1984 | [JP] | Japan | 59-59731 |

[51] Int. Cl.[4] ..... G03G 5/082; G03G 5/14

[52] U.S. Cl. ..... 430/58; 430/65; 430/66; 430/67

[58] Field of Search ..... 430/57, 58, 65, 66, 430/67

[56] References Cited

U.S. PATENT DOCUMENTS

| | | | |
|---|---|---|---|
| 4,394,425 | 7/1983 | Shimizu et al. | 430/65 |
| 4,394,426 | 7/1983 | Shimizu et al. | 430/65 |
| 4,460,669 | 7/1984 | Ogawa et al. | 430/57 |
| 4,460,670 | 7/1984 | Ogawa et al. | 430/57 |
| 4,510,224 | 4/1985 | Yamazaki et al. | 430/65 X |
| 4,536,460 | 6/1985 | Kanbe et al. | 430/57 |

FOREIGN PATENT DOCUMENTS

| | | | |
|---|---|---|---|
| 3412184 | 10/1984 | Fed. Rep. of Germany | 430/65 |
| 59-67540 | 4/1984 | Japan | 430/65 |
| 59-119358 | 7/1984 | Japan | 430/65 |

*Primary Examiner*—Roland E. Martin

*Attorney, Agent, or Firm*—Frishauf, Holtz, Goodman & Woodward

[57] ABSTRACT

Disclosed is a photoreceptor which comprises a charge generation layer composed of at least one compound selected from the group consisting of amorphous hydrogenated silicon, amorphous fluorinated silicon and amorphous hydrofluorinated silicon, a charge transport layer formed on a lower surface of said charge generation layer and composed of at least one compound selected from the group consisting of amorphous hydrogenated silicon nitride, amorphous fluorinated silicon nitride, amorphous hydrofluorinated silicon nitride, amorphous hydrogenated silicon carbide, amorphous fluorinated silicon carbide and amorphous hydrofluorinated silicon carbide, and a substrate, wherein said charge transport layer contains oxygen within the range of from 50 atomic ppm to 5 atomic % based on the total atoms of silicon, nitrogen and carbon. The photoreceptor of this invention can be improved in the electrophotographic characteristics greatly with reduction of dependency on temperature by making the oxygen content in the charge transport layer 50 atomic ppm to 5 atomic %.

32 Claims, 3 Drawing Sheets

MULTILAYER PHOTORECEPTOR

This application is a continuation of application Ser. No. 910,242, filed Sept. 18, 1986, now abandoned, which is a continuation-in-part of Ser. No. 867,415 filed May 15, 1986 (abandoned); which is a continuation of Ser. No. 716,190 filed Mar. 26, 1985 (abandoned).

BACKGROUND OF THE INVENTION

This invention relates to a photoreceptor, for example, an electrophotographic photoreceptor.

In the prior art, as the electrophotographic photoreceptors, those having ZnO or CdS dispersed in a resin binder have been known. However, these photoreceptors involve problems with respect to environmental pollution, thermal stability and mechanical strength.

On the other hand, electrophotographic photoreceptors employing amorphous silicon (a-Si) as matrix have recently been proposed. a-Si has the so called dangling bonds formed by cleavage of the bondings of Si—Si, and there exist a large number of localized levels within the energy gap caused by these defects. For this reason, hopping conduction of thermally excited carrier occurs to make dark resistance smaller and also worsen the photoconductivity by trapping of the photo-excited carrier in the localized levels. Accordingly, it has been practiced to compensate the above defects with hydrogen atoms to bond Si to H, thereby embedding dangling bonds in the matrix.

Such an amorphous hydrogenated silicon (hereinafter called a-Si:H) has a resistivity in the dark place of $10^8$ to $10^9$ Ω-cm, which is about lower by 1/10000th as compared with amorphous Se. Accordingly, a photoreceptor comprising a monolayer of a-Si:H has the problems of great dark decay speed of the surface potential and low initial charging potential. However, on the other hand, when a light in the visible and infrared regions is irradiated, the resistivity can be greatly reduced and therefore it has very excellent characteristics as the photosensitive layer of a photoreceptor.

FIG. 1 shows an electrophotographic copying machine in which an a-Si type photoreceptor employing the above a-si:H is incorporated as a body material. In this copying machine, a manuscript mounting stand 3 made of glass for mounting the manuscript 2 and a platen cover 4 for covering the manuscript 2 are arranged on the upper part of the cabinet 1. Below the manuscript stand 3, an optical scanning stand comprising as first mirror unit 7 equipped with a light source 5 and a first mirror for reflection 6 is provided so as to be linearly movable in the left and right directions in the Figure, and a second mirror unit 20 for making constant the optical path between the manuscript scanning point and the photoreceptor moves corresponding to the speed of the first mirror unit, thereby permitting the reflected light from the manuscript side to be incident through the lens 21 and the mirror for reflection 8 on the photoreceptor drum 9 in shape of a slit. Around the drum 9, there are arranged a corona charger 10, a developing instrument 11, a transfer section 12, a separating section 13 and a cleaning section 14, respectively. The copying paper 18 delivered from the feed paper box 15 via the respective paper feeding rollers 16 and 17 receives the toner image by transfer from the drum 9 and further fixed at the fixing section 19 before discharged into the tray 35. At the fixing section 19, fixing operation is conducted by passing the developed copying paper between the heating roller 23 including internally a heater 22 and the pressurizing roller 24.

However, a photoreceptor having the surface of a-Si:H has not been investigated fully about the chemical stability of the surface such the influences when exposed to the air or humidity over a long term or the influences by the chemical species formed by corona discharging. For example, such a photoreceptor after being left to stand for one month or longer has been known to receive influence by himidity, whereby the receptive potential is markedly lowered. On the other hand, concerning amorphous hydrogenated silicon carbide (hereinafter called as a-SiC:H), its preparation method and existence are disclosed in "Phil. Mag. Vol. 35" (1978), etc., and its characteristics are reported to reside in heat resistance, high surface hardness, higher dark resistivity ($10^{12}$–$10^{13}$ Ω-cm) as compared with a-Si:H, and variable optical energy gas over the range of 1.6 to 2.8 eV depending on the carbon content. However, there is involved the drawback that the long wavelength sensitivity is worsened due to the broadened band gap caused by inclusion of carbon.

Such an electrophotographic photoreceptor comprising a combination of a-SiC:H and a-Si:H is disclosed in, for example, Japanese Provisional Patent Publication No. 127083/1980. According to this disclosure, there is prepared a function separation type two-layer structure in which an a-Si:H layer is used as the charge generation (photoconductive) layer and an a-SiC:H layer is provided as the charge transport layer beneath the charge generation layer, with the upper layer a-Si:H attaining photosensitivity in broader wavelength region and improvement of charging potential being intended by the lower layer a-SiC:H which forms a hetero-junction with the a-Si:H layer. However, dark decay cannot sufficiently be prevented and the charging potential is still unsatisfactory to be impractical in such a photoreceptor. Moreover, existence of the a-Si:H layer on the surface will worsen chemical stability, mechanical strength, heat resistance, etc.

On the other hand, Japanese Provisional Patent Publication No. 17592/1982 discloses a photoreceptor of a function separation type three-layer structure constructed by forming a first a-SiC:H layer as the surface modifying layer on a charge generation layer comprising a-Si:H and forming a second a-Sic:H layer as the charge transport layer on the back surface (on the substrate electrode side).

Whereas, in the known photoreceptors, it has been discovered that the problems as mentioned below is involved particularly in the a-SiC:H charge transport layer.

That is, although the known a-SiC:H may be acceptable in charge transporting ability (carrier range ($\mu\tau$)=mobility ×life time) and charge retentivity (dark resistance $\rho_D$), temperature dependency of $\rho_D$ is great, whereby the retentivity of charged potential at higher temperature will be deteriorated to the extent unacceptable in practical application. Such a defect will also ensue when the charge transport layer is constituted of an amorphous silicon nitride (a-SiN).

SUMMARY OF THE INVENTION

An object of this invention is to provide a photoreceptor which can retain stably high charged potential (particularly under high temperature or high humidity), and is excellent in light fatigue characteristic.

More specifically, the photoreceptor according to this invention comprises a charge generation layer composed of at least one compound selected from the group consisting of amorphous hydrogenated silicon, amorphous fluorinated silicon and amorphous hydrofluorinated silicon, a charge transport layer formed on a lower surface of said charge generation layer and composed of at least one compound selected from the group consisting of amorphous hydrogenated silicon nitride, amorphous fluorinated silicon nitride, amorphous hydrofluorinated silicon nitride, amorphous hydrogenated silicon carbide, amorphous fluorinated silicon carbide and amorphous hydrofluorinated silicon carbide, and a substrate, wherein said charge transport layer contains oxygen within the range of from 50 atomic ppm to 5atomic % based on the total atoms of silicon, nitrogen and carbon.

Further, in the above construction of the photoreceptor of this invention, said charge transport layer may contain at least one element of IIIa group of the periodic table in an amount up to 50 atomic ppm based on the total amount of silicon, nitrogen and carbon, and there may also be provided beneath said charge transport layer a charge blocking layer, which is composed of at least one compound selected from the group consisting of amorphous hydrogenated silicon nitride, amorphous fluorinated silicon nitride, amorphous hydrofluorinated silicon nitride amorphous hydrogenated silicon carbide, amorphous fluorinated silicon carbide and amorphous hydrofluorinated silicon carbide and which contains elements of IIIa group of the periodic table within the range of from 100 atomic ppm to 5000 atomic ppm based on the total amount of silicon, nitrogen and carbon.

BRIEF DESCRIPTION OF THE DRAWINGS

FIGS. 2 through 6 show examples of this invention, in which:

FIG. 2 and FIG. 3 are sectional views of a-Si type photoreceptors;

FIG. 4 is a schematic sectional view of a glow discharge device;

FIG. 5 is a schematic sectional view of a vacuum vapor deposition device; and FIG. 6 is a sectional view of a gas discharge tube.

DESCRIPTION OF THE PREFERRED EMBODIMENTS

According to this invention, the photoreceptor is a function separation type photoreceptor containing 50 atomic ppm to 5 atomic % of oxygen in its charge transport layer and therefore $\rho_D$ can be effectively elevated without lowering the charge transporting ability ($\mu\tau$), whereby the temperature dependency of $\rho_D$ ($d\rho_D/dT$) can be suppressed small. For this reason, the retentivity characteristic of charged potential can be improved to enhance the upper limit temperature (similarly the upper limit humidity) available for the photoreceptor. If the above oxygen content is less than 50 atomic ppm, the effect by oxygen incorporation cannot be exhibited. On the other hand, a content in excess of 5 atomic % gives too much oxygen, whereby mobility of the carrier, namely ($\mu\tau$) will markedly be lowered. Thus, it is essentially indispensable to set the oxygen content at 50 atomic ppm to 5 atomic %, particularly at 50 atomic to 500 atomic ppm. Moreover, since the charge transport layer contains a relatively small amount of the elements belonging to the group IIIa of the periodic table (lightly doped), they make contributions to good injection of carriers from the charge generation layer to the charge transport layer.

Also, when a charge blocking layer containing a relatively large amount of the elements belonging to the group IIIa of the periodic table (heavily doped) is provided beneath the charge transport layer, injection of electrons from the supporting substrate side can effectively be impeded during positive charging of the photoreceptor to give excellent charge potential retentivity in use of the photoreceptor for positive charging.

Referring now to preferred embodiments, this invention is to be described in detail.

Figure 1:
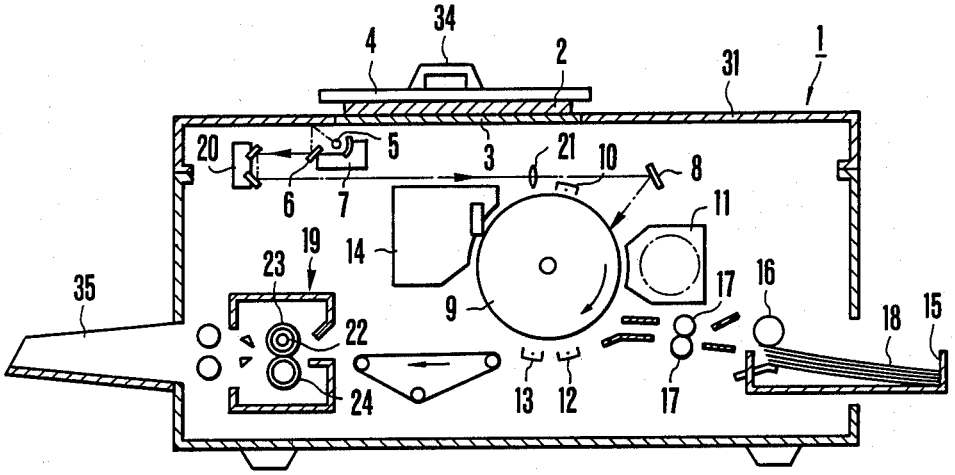
FIG. 1 shows a schematic sectional view of an electrophotographic copying machines of the prior art.
Figure 2:
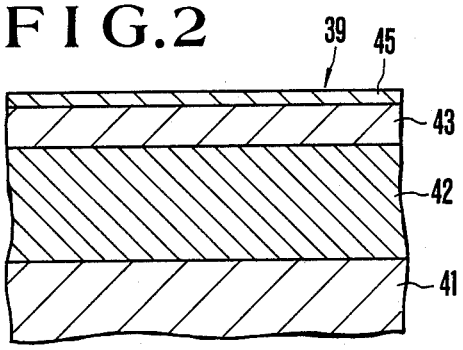

FIG. 2 shows an a-Si type electrophotographic photoreceptor 39 for negative charging according to a preferred embodiment of this invention. The photoreceptor 39 has a structure, having a charge transport layer 42 comprising a-SiC:H or a-SiN:H containing 50 atomic ppm to 5 atomic % of oxygen, a charge generation layer 43 comprising a-Si:H and a surface modifying layer 45, which is optionally provided and comprises an inorganic material such as amorphous hydrogenated silicon carbide or nitride (a-SiC:H or a-SiN:H) or $SiO_2$, laminated on a drum-shaped electroconductive supporting substrate 41. The charge generation layer 43 has a ratio of the dark resistivity $\rho_D$ to the resistivity during light irradiation $\rho_L$, which is sufficiently large for an electrophotographic photoreceptor, and has good photosensitivity (particularly to the light in the visible and infrared regions).

In the photoreceptor 39 shown in FIG. 2, based on this invention, oxygen atoms are contained in the charge transport layer 42 comprising a-SiC:H or a-SiN:H in an amount of 50 atomic ppm to 5 atomic % based on 100 atomic % of the total atom number of Si+C or Si+N. By the content of oxygen atoms within this range, $\rho_D$ of the charge transport layer 42 can be high even under high temperature (or high himidity), whereby the charged potential retentivity for photoreceptor can be stably maintained.

Figure 3:
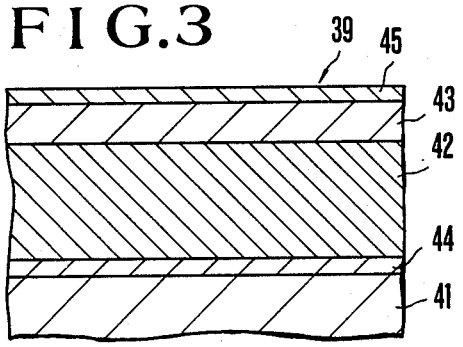

In this invention, the photoreceptor can be constructed as shown in FIG. 3. That is, the photoreceptor 39 has a structure, having a p-type charge blocking layer 44 comprising a-SiC:H or a-SiN:H heavily doped with an element belonging to the group IIIa of the periodic table, for example, boron, a charge transport layer 42 comprising a-SiC:H or a-SiN:H lightly doped with an element belonging to the group IIIa of the periodic table, for example, boron, and containing 50 atomic ppm to 5 atomic % of oxygen, a charge generating layer 43 comprising a-Si:H, and a surface modifying layer 45, which is optionally provided and comprises an inorganic material such as amorphous hydrogenated silicon carbide or nitride (a-SiC:H or a-SiN:H) or $SiO_2$, laminated on a drum-shaped electroconductive supporting substrate 41. The charge generation layer 43 has a ratio of the dark resistivity $\rho_D$ to the resistivity during light irradiation $\rho_L$, which is sufficiently large for an electrophotographic photoreceptor, and has good photosensitivity (particularly to the light in the visible and infrared regions).

In the photoreceptor 39 shown in FIG. 3, based on this invention, oxygen atoms are contained in the charge transport layer 42 comprising a-SiC:H or a-SiN:H in an amount of 50 atom ppm to 5 atomic% based on 100 atomic % of the total atom number of Si+C or Si+N. By the content of oxygen atoms within this range, $\rho_D$ of the charge transport layer 42 can be high even under high temperature (or high humidity), whereby the charged potential retentivity for photoreceptor can be stably maintained.

Further, the charge blocking layer may contain oxygen. In such a case, preferable oxygen content is 50 atomic ppm to 5 atomic % based on the total atom number of Si+C or Si+Ni.

The content of carbon atoms or nitrogen atoms in the charge transport layer and the charge blocking layer should preferably be 5 to 30 atomic %, respectively (the total number of atoms of Si+C or Si+N is made 100 atomic %), and the film thickness of the charge transport layer should adequately be made 10 to 30 μm.

Also, the charge transport layer 42 is lightly doped with an element belonging to the group IIIa of the periodic table preferably in an amount of 50 atomic ppm or less, and it is subjected to light doping with boron by, for example, glow discharge decomposition at a flow rate ratio of $B_2H_6/SiH_4=1-50$ volume ppm.

The above charge blocking layer 44, in order to avoid sufficiently injection of electrons from the substrate 41, is heavily doped with an element belonging to the group IIIa of the periodic table (e.g. boron) preferably in an amount of 100 to 5000 atomic ppm, and should preferably be made p-type (further $p^+$-type) by doping, for example, by glow discharge decomposition at a flow rate ratio of $B_2H_6/SiH_4=100-5000$ volume ppm.

In each layer of the photoreceptor of the present invention, atoms constituting the layers are uniformly distributed therein in predetermined amounts within the range of preparative error.

Further, the charge generation layer 43 may be lightly doped with an element belonging to the group IIIa of the periodic table.

As for the thickness of each layer as described above, the charge generation layer 43 should preferably have a thickness of 1 to 10 μm, the blocking layer 44 a thickness of 400 Å to 2 μm. If the thickness of the charge generation layer is less than 1 μm, no sufficient photosensitivity can be obtained, while a thickness over 10 μm will result in elevation of residual potential to be practically unsatisfactory. Also, if the thickness of the blocking layer 44 is less than 400 Å, the blocking effect is weak, while a thickness over 2 μm tends to worsen the charge transporting ability.

The above surface modifying layer 45 is desirably provided to modify the surface of the photoreceptor, thereby making the a-Si type photoreceptor practically excellent. In other words, it enables basic actuations of an electrophotographic photoreceptor of charge retention on the surface and decay of the surface potential by photoradiation. Accordingly, the repeating characteristic of charge and light decay becomes very stable, and good potential characteristics can be reproduced even after being left to stand over a long term (e.g. one month or longer). In the case of a photoreceptor having a surface of a-Si:H, it is susceptible to influences by atmospheric conditions such as humidity, air, ozone, etc. and the potential characteristics will be changed readily with lapse of time. Also, since the surface modifying layer 45 comprising a-SiC:H or a-SiN:H has a high surface hardness, it has abrasion resistance in the steps of developing, transfer and cleaning, and also good heat resistance, and therefore a process giving heat such as tack-transfer may also be applicable.

In order to exhibit all of such excellent effects, it is important for surface modifying layer to select a suitable composition for carbon or nitrogen in a-SiC-H or a-SiN:H. That is, it is desirable that the content of carbon or nitrogen atoms should be 10 to 70 atomic %, when the Si+C (or N) is made equal to 100%. If the content of C or N is 10 atomic % or more, the specific resistivity as mentioned above can be a desired value and the optical energy gap approximately 2.0 eV or higher, whereby through the so-called optically transparent window effect relative to visible and infrared light, the irradiated light can easily reach the a-Si:H layer (charge generation layer) 43. However, if the C or N content is less than 10 atomic %, the specific resistance is liable to be lower than the desired value, and a part of the light will be absorbed by the surface layer 45, and the photoreceptor tends to be lowered in photosensitivity. On the other hand, if the C or N content exceeds 70 atomic %, the amount of carbon or nitrogen is too much and semiconductor characteristics tend to be lost. Moreover, the deposition speed during formation of a-SiC:H or a-SiN:H according to the glow discharge method will readily be lowered. Thus, the content of C or N should peferably be made not higher than 70 atomic %.

Also, it is important to select the film thickness of A-SiC:H or a-SiN:H layer 45 within the range of 400 Å≦t≦5000 Å (particularly 400 Å≦t≦2000 Å). That is, if the film thickness exceeds 5000 Å, the residual potential $V_R$ will become too high and lowering in photosensitivity will also occur, whereby good characteristics of a-Si type photoreceptor are liable to be lost. On the other hand, if the film thickness is made less than 400 Å, the charges may fail to be charged on the surface through the tunnel effect, whereby increase of dark decay or lowering in photosensitivity will occur.

Further, the surface modifying layer 45 may contain oxygen. In such a case, resistivity increses and therefore it is possible to prevent charge from invading from the surface thereof under the condition of high temperature and high humidity. Preferable oxygen content is 1 to 50 atomic %, especially 6 to 30 atomic % of total amount of Si+C+O or Si+N+O.

Each of the above layers is required to contain hydrogen or fluorine. Particularly, the hydrogen content in the charge generation layer 43 is essentially indispensable for compensation of the dangling bonds to improve photoconductivity and charge retentivity, and should desirably be 1 to 40 atomic %, especially 10 to 30 atomic %, based on 100 atomic % of the total amount of silicon and hydrogen. The fluorine content in the charge generation layer should desirably be 0.01 to 20 atomic %, especially 0.5 to 10 atomic % of total amount of silicon and fluorine. Hydrogen and fluorine may form fluorohydrogenated silicon within the content range as mentioned above. The content range is also applicable similarly to the surface modifying layer 45, the blocking layer 44 and the charge transport layer 42. Also, as the impurity for controlling the conduction type of the blocking layer 44 to make it p-type, or as the doping impurity for the charge transport layer 42, in addition to boron, other elements of the group IIIa of the periodic table such as Al, Ga, In, Tl, etc. may also be available.

Figure 4:
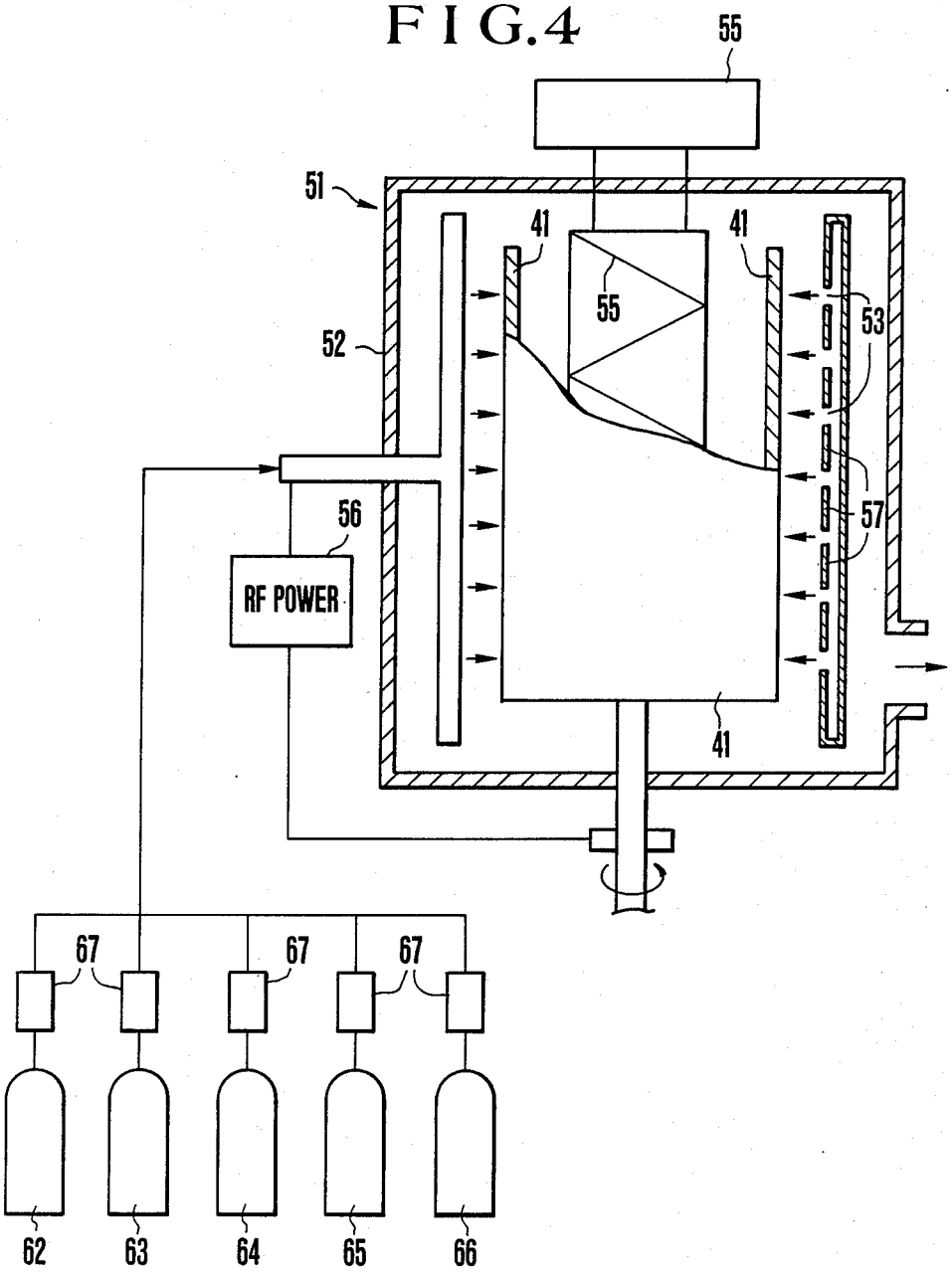

Next, the method for preparation of the photoreceptor as described above (for example, drum-shaped photoreceptor) and a device therefor (glow discharge device) are to be described by referring to FIG. 4.

In the vacuum tank 52 of the device 51, a drum-shaped substrate 41 is set vertically and rotatably, and the substrate 41 can be heated from its innerside by the heater 55 to a predetermined temperature. Faced to the substrate 41, surrounding therearound, there is arranged a cylindrical high frequency electrode 57 equipped with a gas inlets 53, and glow discharging is excited by the high frequency power source 56 between the substrate 41 and the electrode 57. In this Figure, reference numeral 62 shows a supply source for $SiH_4$ or a gaseous silicon compound, 63 a supply source for $O_2$ or a gaseous oxygen compound, 64 a supply source for a hydrocarbon gas such as $CH_4$ or a nitrogen compound gas such as $NH_3$, $N_2$, etc., 65 a supply source for a carrier gas such as Ar, etc., 66 a supply source for an impurity gas (e.g. $B_2H_6$) and 67 a flow meter of each gas. In this glow discharge device, first the surface of the support such as the aluminum substrate 41 is cleaned and thereafter arranged in the vacuum tank 52, followed by evacuation by controlling the gas pressure within the vacuum tank 52 to $10^{-6}$ Torr, and the substrate 41 is heated and maintained at a predetermined temperature, particularly 100° to 350° C. (desirably 150° to 300° C.). Next, by using a high purity inert gas as the carrier gas, $SiH_4$ or a gaseous silicon compound, $B_2H_6$, $CH_4$ (or $NH_3$, $N_2$) or $O_2$ is conveniently introduced into the vacuum tank 52, wherein a high frequency voltage (e.g. 13.56 MHz) is applied from the high frequency power source 56 under the reaction pressure of, for example, 0.01 to 10 Torr. By such operations, the above respective reactive gases are subjected to glow discharge decomposition between the electrode 57 and the substrate 41, thereby depositing continuously (namely corresponding to the embodiment shown in FIG. 3) a boron heavy doped p-type SiC:H or a-SiN:H, a boron light doped oxygen containing a-SiC:H or a-SiN:H, a-Si:H, a-SiC:H or a-SiN:H as the above layers 44, 42, 43 nd 45 on the substrate. The boron heavy doped p-type a-SiC:H or a-SiN:H (layer 44) may be omitted as shown in FIG. 2.

In the above prepartion method, since the substrate temperature is controlled at 100° to 350° C. in the step of film formation of the a-Si type layer, the film quality (particularly electrical characteristics) can be improved.

During formation of the respective layers for the above a-Si type photoreceptor, for compensation of dangling bonds, fluorine can be introduced in the form of $SiF_4$, etc. in place of H or in combination with H to form a-Si:F, a-Si:H:F, a-SiN:F, a-SiN:H:F, a-SiC:F or a-SiC:H:F. In this case, the content of hydrogen or fluorine should desirably be 1 to 40 atomic % or 0.01 to 20 atomic %, respectively, based on the total amount of hydrogen or fluorine and silicon.

The above preparation method is carried out according to the glow discharge decomposition method, but otherwise it is also possible to prepare the above photoreceptor according to the sputtering method, the ion plating method or the method in which Si is vaporized under introduction of hydrogen activated or ionized in a hydrogen discharging tube [particularly the method disclosed in Japanese Provisional Patent Publication No. 78413/1981 (Japanese patent application No. 152455/1979) by the present Applicant].

Figure 5:
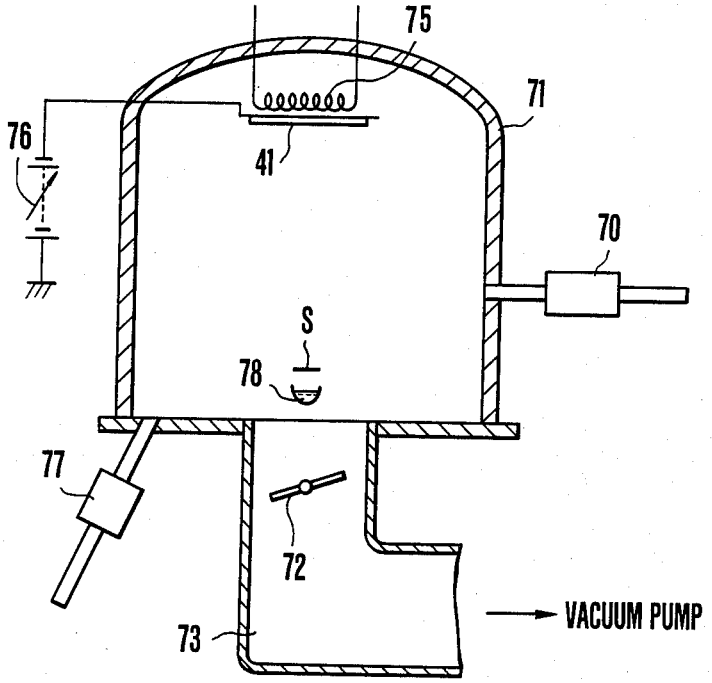

FIG. 5 shows a vapor deposition device to be used for preparation of the photoreceptor of this invention by the vapor deposition method disclosed in the above Japanese Provisional Patent Publication No. 78413/1981.

The bell jar 71 has a vacuum pump (not shown) connected thereto through an evacuating pipe 73 having a butterfly valve 72, through which said bell jar 71 is evacuated to high vacuum of, for example, $10^{-3}$ to $10^{-7}$ Torr. Within said bell jar 71 is asrranged a substrate 41, which is heated by a heater 75 to a temperature of 100° to 350° C., preferably 150° to 300° C., and at the same time a direct current negative voltage of 0 to −10 KV, preferably −1 to −6 KV, is aspplied from the direct current power source 76 on the substrate 41. For formation of the a-Si:H layer 43, while introducing activated hydrogen and hydrogen ions into the bell jar 71 from the hydrogen gas discharging tube 77 of which outlet is provided connected to the bell jar 71 so as to confront the substrate 41, the silicon vaporizing source 78 provided so as to confront the substrate 41 is heated simultaneously with opening of the upper shutter S. For formation of the a-SiC:H layer 45, under supply of $CH_4$, silicon is vaporized. The oxygen containing a-SiC:H layer 42 can be formed by further supplying oxygen gas. The oxygen containing a-SiN:H layer 42 can be formed by supplying further $NH_3$ or $N_2$ together with oxygen gas in place of $CH_4$. $CH_4$, $NH_3$, $N_2$ and $O_2$ may conveniently be activated by the discharging tube 70 before introduction into the bell jar. For formation of the charge blocking layer 44, silicon 78 and aluminum 79 may be vaporized.

Figure 6:
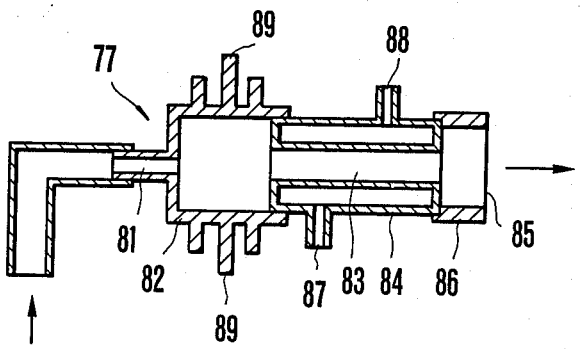

To describe in detail about the structure of the discharging tubes 77, 70, for example, the structure of the discharging tube 77 comprises, as shown in FIG. 6, one cylindrical electrode member 82 having a gas inlet 81, a discharge space member 84 made of, for example, cylindrical glass surrounding the discharge space 83 provided on one end of the one electrode member 82 and the other ring-shaped electrode member 86 having an outlet 85 provided on the other end of the discharge space member 84. By application of direct current or alternating current voltage between the one electrode member 82 and the other electrode member 86, the gas supplied through the gas inlet 81, for example, hydrogen gas is subjected to glow discharging in the discharge space 83, whereby activated hydrogen and ionized hydrogen ions comprising hydrogen atoms or molecules activated by electron energy are discharged from the outlet 85. The discharge space member 82 according to this example shown in the Figure has a double-pipe structure, having a construction capable of permitting cooling water to pass therethrough, 87 and 88 indicating the inlet and outlet for cooling water. 89 is the fin for cooling the one electrode member 82. The electrode distance in the above hydrogen gas discharging tube 77 is 10 to 15 cm, and the applied voltage is 600 V, with the pressure in the discharge space 83 being made about $10^{-2}$ Torr.

This invention described in more detail by referring to the following Examples.

EXAMPLE 1

An electrophotographic photoreceptor having a structure as shown in FIG. 2 was prepared on a drum-shaped aluminum substrate according to the glow discharge decomposition method. That is, first, a support, for example, a drum-shaped aluminum substrate 41 having smooth surface was cleaned on its surface and arranged in a vacuum tank 52 in FIG. 4, the tank 52 was evacuated by controlling to a gas pressure in the tank of $10^{-6}$ Torr, and the substrate 41 was heated and held at a predetermined temperature, particularly 100° to 350°

C. (desirably 150° to 300° C.). Next, high purity Ar gas was introduced as the carrier gas into the tank and a high frequency power of 13.56 Hz was applied under the back pressure of 0.5 Torr to effect pre-discharging for 10 minutes. Then, the reactive gases comprising $SiH_4$, $O_2$ and $CH_4$ or $N_2$ are introduced into the tank and the gas mixture of ($Ar+SiH_4+CH_4$ or $N_2+O_2$) at a flow rte ratio of $1:1:1:1\times10^{-3}$ was subjected to glow discharge decomposition, whereby oxygen containing a-SiC:H or a-SiN:H charge transport layer 42 was formed to a desired thickness at a deposition speed of 6 μm/hr. Subsequently, feeding of $CH_4$ or $N_2$ was stopped and $SiH_4$ was decomposed by discharging to form a-Si:H layer 43. Subsequently, glow discharge decomposition was effected with a gas mixture of ($Ar+SiH_4+CH_4$) at a flow rate ratio of 4:1:6 to provide further a surface protective layer 45 of a-SiC:H to complete an electrophotographic photoreceptor. By use of this photoreceptor, image formation was carried out by means of a copy machine (Modified U-Bix 3000 machine, produced by Konishiroku Photo Industry Co.). As the result, clear images with good resolution and gradation, having high image density without fog, were obtained. Also, when repeated copying was carried out for 200,000 times, stable and good images could be obtained continuously.

That is, in carrying out the test, the electrophotographic photoreceptor as prepared above was mounted on an electrometer SP-428 Model produced by Kawaguchi Denki K.K., and charging operation was carried out for 10 seconds with an applied voltage on the charger of −6 KV relative to the discharging electrodes, and the charged potential on the surface of the receptor immediately after charging operation is defined as Vo (V), and after dark decay for two seconds, the dose of irradiation necessary for halving the charged voltage is defined as the halving exposure quantity $E_{\frac{1}{2}}$ (lux·sec). The light decaying curve of the surface potential may sometimes become flat at a finite potential and cannot become completely zero, and this potential is called residual potential $V_R$ (V).

When the compositions of the respective layers were changed variously, the results shown in Table 1 were obtained. From these results, it can be seen that the electrophotographic characteristics of the photoreceptor can be improved greatly with reduction of dependency on temperature by making the oxygen content in the charge transport layer 50 atomic ppm to 5 atomic %. As to the image quality, the mark ⊙ indicates clear image, the mark ○ good image and the mark × practically unacceptable image.

TABLE 1

| | Charge transport layer | | | | | Charge generation layer | | | Surface modifying layer | | | | |
|---|---|---|---|---|---|---|---|---|---|---|---|---|---|
| Sample No. | Composition | Amount of O doped (ppm) | C or N (%) | H (%)/F (%) | Film thickness (μm) | Composition | H (%)/F (%) | Film thickness (μm) | Composition | C or N (%) | O (%) | H (%)/F (%) | Film thickness (μm) |
| 1 | a-SiC:H | 50 | 15 | 20/0 | 15.5 | a-Si:H | 18/0 | 4.5 | a-SiC:H | 40 | 0 | 20/0 | 0.15 |
| 2 | a-SiC:H | 500 | 15 | 20/0 | 15.5 | a-Si:H | 18/0 | 4.5 | a-SiC:H | 40 | 0 | 20/0 | 0.15 |
| 3 | a-SiC:H | 5000 | 15 | 20/0 | 15.5 | a-Si:H | 18/0 | 4.5 | a-SiC:H | 40 | 0 | 20/0 | 0.15 |
| 4 | a-SiC:H | 50000 | 15 | 20/0 | 15.5 | a-Si:H | 18/0 | 4.5 | a-SiC:H | 40 | 0 | 20/0 | 0.15 |
| 5 | a-SiC:H | 30 | 15 | 20/0 | 15.5 | a-Si:H | 18/0 | 4.5 | a-SiC:H | 40 | 0 | 20/0 | 0.15 |
| 6 | a-SiC:H | 70000 | 15 | 20/0 | 15.5 | a-Si:H | 18/0 | 4.5 | a-SiC:H | 40 | 0 | 20/0 | 0.15 |
| 7 | a-SiC:H/F | 100 | 11 | 16/5 | 15.5 | a-Si:H/F | 17/6 | 4.5 | a-SiCO:H/F | 35 | 20 | 16/5 | 0.15 |
| 8 | a-SiC:H/F | 200 | 28 | 16/5 | 15.5 | a-Si:H/F | 17/6 | 4.5 | s-SiNO:H/F | 35 | 20 | 17/5 | 0.15 |
| 9 | a-SiN:H | 50 | 12 | 18/0 | 15.5 | a-Si:H | 18/0 | 4.5 | a-SiC:H | 40 | 0 | 20/0 | 0.15 |
| 10 | a-SiN:H | 500 | 12 | 18/0 | 15.5 | a-Si:H | 18/0 | 4.5 | a-SiC:H | 40 | 0 | 20/0 | 0.15 |
| 11 | a-SiN:H | 5000 | 12 | 18/0 | 15.5 | a-Si:H | 18/0 | 4.5 | a-SiC:H | 40 | 0 | 20/0 | 0.15 |
| 12 | a-SiN:H | 50000 | 12 | 18/0 | 15.5 | a-Si:H | 18/0 | 4.5 | a-SiC:H | 40 | 0 | 20/0 | 0.15 |
| 13 | a-SiN:H | 30 | 12 | 18/0 | 15.5 | a-Si:H | 18/0 | 4.5 | a-SiC:H | 40 | 0 | 20/0 | 0.15 |
| 14 | a-SiN:H | 70000 | 12 | 18/0 | 15.5 | a-Si:H | 18/0 | 4.5 | a-SiC:H | 40 | 0 | 20/0 | 0.15 |
| 15 | a-SiN:H/F | 100 | 9 | 16/5 | 15.5 | a-Si:H/F | 17/6 | 4.5 | a-SiCO:H/F | 35 | 20 | 16/5 | 0.15 |
| 16 | a-SiN:H/F | 200 | 25 | 17/5 | 15.5 | a-Si:H/F | 17/6 | 4.5 | a-SiNO:H/F | 35 | 20 | 17/5 | 0.15 |

| | Photoreceptor use temperature | | | | | | | |
|---|---|---|---|---|---|---|---|---|
| | 20° C. | | | | 50° C. | | | |
| Sample No. | Charged potential Vo (V) | Halving exposure quantity $E_{\frac{1}{2}}$ (lux · sec) | Residual potential $V_R$ (V) | Image quality 200,000 copies | Charged potential Vo (V) | Halving exposure quantity $E_{\frac{1}{2}}$ (lux · sec) | Residual potential $V_R$ (V) | Image quality 200,000 copies |
| 1 | −710 | 0.6 | 10 | ⊙ | −640 | 0.6 | 7 | ⊙ |
| 2 | −740 | 0.7 | 20 | ⊙ | −670 | 0.7 | 10 | ⊙ |
| 3 | −770 | 0.8 | 30 | ⊙ | −690 | 0.7 | 20 | ⊙ |
| 4 | −800 | 0.9 | 40 | ○ | −720 | 0.8 | 30 | ⊙ |
| 5 | −650 | 0.6 | 10 | ⊙ | −410 | 0.6 | 7 | X |
| 6 | −860 | 1.8 | 80 | X | −620 | 1.8 | 80 | X |
| 7 | −720 | 0.6 | 10 | ⊙ | −650 | 0.6 | 10 | ⊙ |
| 8 | −790 | 0.8 | 30 | ⊙ | −710 | 0.7 | 30 | ⊙ |
| 9 | −700 | 0.6 | 15 | ⊙ | −650 | 0.6 | 10 | ⊙ |
| 10 | −735 | 0.7 | 15 | ⊙ | −670 | 0.7 | 15 | ⊙ |
| 11 | −760 | 0.7 | 30 | ⊙ | −690 | 0.7 | 25 | ⊙ |
| 12 | −790 | 0.9 | 40 | ○ | −710 | 0.8 | 30 | ⊙ |
| 13 | −640 | 0.6 | 10 | ⊙ | −400 | 0.6 | 10 | X |
| 14 | −870 | 2.0 | 90 | X | −640 | 1.9 | 80 | X |
| 15 | −730 | 0.7 | 15 | ⊙ | −660 | 0.7 | 15 | ⊙ |
| 16 | −800 | 0.8 | 25 | ⊙ | −730 | 0.8 | 25 | ⊙ |

EXAMPLE 2

An electrophotographic photoreceptor having a structure as shown in FIG. 3 was prepared on a drum-shaped aluminum substrate according to the glow discharge decomposition method. That is, first, a support, for example, a drum-shaped aluminum substrate 41 having smooth surface was cleaned on its surface and arranged in a vacuum tank 52 in FIG. 4, the tank 52 was evacuated by controlling to a gas pressure in the tank of $10^{-6}$ Torr, and the substrate 41 was heated and held at a predetermined temperature, particularly 100° to 350° C. (desirably 150° to 300° C.). Next, high purity Ar gas was introduced as the carrier gas into the tank and a high frequency power of 13.56 MHz was applied under the back pressure of 0.5 Torr to effect pre-discharging for 10 minutes. Then, the reactive gases comprising $SiH_4$, $CH_4$ or $N_2$, $B_2H_6$ and $O_2$ are introduced into the tank and the gas mixture of ($Ar+SiH_4+CH_4$ or $N_2+B_2H_6+O_2$) at a flow rte ratio of $1:1:1:(1.5\times10^{-3}):5\times10^{-4}$ was subjected to glow discharge decomposition, whereby a p-type a-SiC:H layer or a p-type a-SiN:H layer 44 bearing the charge blocking function was formed, and further the gas mixture of ($Ar+SiH_4+CH_4$ or $N_2+B_2H_6+O_2$) was fed into the tank to form a charge transport layer 42 to a desired thickness at a deposition speed of 6 μm/hr. Subsequently, feeding of $CH_4$, $B_2H_6$ or $N_2$ and $O_2$ was stopped and $SiH_4$ was decomposed by discharging to form a-Si:H layer 43 of a desired thickness. Subsequently, glow discharge decomposition was effected with a gas mixture of ($Ar+SiH_4+CH_4$) at a flow rate ratio of 4:1:6 to provide further a surface protective layer 45 of a-SiC:H to complete an electrophotographic photoreceptor. By use of this photoreceptor, image formation was carried out by means of a copying machine (Modified U-Bix 3000 machine, produced by Konishiroku Photo Industry Co.). As the result, clear images with good resolution and gradation, having high image density without fog, were obtained. Also, when repeated copying was carried out for 200,000 times, stable and good images could be obtained continuously.

That is, similarly as in Example 1, when the compositions of the respective layers were changed variously, the results shown in Table 2 were obtained. From these results, it can be seen that the electrophotographic characteristics of the photoreceptor can be improved greatly with reduction of dependency on temperature by making the oxygen content in the charge transport layer 50 ppm to 5%.

TABLE 2

| | Charge blocking layer | | | | | | Charge transport layer | | | | | |
|---|---|---|---|---|---|---|---|---|---|---|---|---|
| Sample No. | Composition | C or N (%) | Amount of O doped (ppm) | Amount of B doped (ppm) | H (%)/F (%) | Film thickness (μm) | Composition | C or N (%) | Amount of O doped (ppm) | Amount of B doped (ppm) | H (%)/F (%) | Film thickness (μm) |
| 17 | a-SiC:H | 15 | 50 | 1500 | 20/0 | 1.0 | a-SiC:H | 15 | 50 | 5 | 20/0 | 14.0 |
| 18 | a-SiC:H | 15 | 500 | 1500 | 20/0 | 1.0 | a-SiC:H | 15 | 500 | 5 | 20/0 | 14.0 |
| 19 | a-SiC:H | 15 | 5000 | 1500 | 20/0 | 1.0 | a-SiC:H | 15 | 5000 | 5 | 20/0 | 14.0 |
| 20 | a-SiC:H | 15 | 50000 | 1500 | 20/0 | 1.0 | a-SiC:H | 15 | 50000 | 5 | 20/0 | 14.0 |
| 21 | a-SiC:H | 15 | 30 | 1500 | 20/0 | 1.0 | a-SiC:H | 15 | 30 | 5 | 20/0 | 14.0 |
| 22 | a-SiC:H | 15 | 70000 | 1500 | 20/0 | 1.0 | a-SiC:H | 15 | 70000 | 5 | 20/0 | 14.0 |
| 23 | a-SiC:H/F | 9 | 100 | 500 | 16/5 | 1.0 | a-SiC:H/F | 9 | 100 | 5 | 16/5 | 14.0 |
| 24 | a-SiC:H/F | 26 | 100 | 500 | 16/5 | 1.0 | a-SiC:H/F | 26 | 100 | 5 | 16/5 | 14.0 |
| 25 | a-SiC:H/F | 15 | 200 | 2500 | 16/5 | 1.0 | a-SiC:H/F | 15 | 200 | 2 | 16/5 | 14.0 |
| 26 | a-SiC:H/F | 15 | 200 | 2500 | 16/5 | 1.0 | a-SiC:H/F | 15 | 200 | 10 | 16/5 | 14.0 |
| 27 | a-SiN:H | 12 | 50 | 1500 | 18/0 | 1.0 | a-SiN:H | 12 | 50 | 5 | 18/0 | 14.0 |
| 28 | a-SiN:H | 12 | 500 | 1500 | 18/0 | 1.0 | a-SiN:H | 12 | 500 | 5 | 18/0 | 14.0 |
| 29 | a-SiN:H | 12 | 5000 | 1500 | 18/0 | 1.0 | a-SiN:H | 12 | 5000 | 5 | 18/0 | 14.0 |
| 30 | a-SiN:H | 12 | 50000 | 1500 | 18/0 | 1.0 | a-SiN:H | 12 | 50000 | 5 | 18/0 | 14.0 |
| 31 | a-SiN:H | 12 | 30 | 1500 | 18/0 | 1.0 | a-SiN:H | 12 | 30 | 5 | 18/0 | 14.0 |
| 32 | a-SiN:H | 12 | 70000 | 1500 | 18/0 | 1.0 | a-SiN:H | 12 | 70000 | 5 | 18/0 | 14.0 |
| 33 | a-SiN:H/F | 8 | 100 | 500 | 17/5 | 1.0 | a-SiN:H/F | 8 | 100 | 5 | 17/5 | 14.0 |
| 34 | a-SiN:H/F | 25 | 100 | 500 | 17/5 | 1.0 | a-SiN:H/F | 25 | 100 | 5 | 17/5 | 14.0 |
| 35 | a-SiN:H/F | 12 | 200 | 2500 | 17/5 | 1.0 | a-SiN:H/F | 12 | 200 | 2 | 17/5 | 14.0 |
| 36 | a-SiN:H/F | 12 | 200 | 2500 | 17/5 | 1.0 | a-SiN:H/F | 12 | 200 | 10 | 17/5 | 14.0 |

| | Carge generation layer | | | Surface modifying layer | | | | |
|---|---|---|---|---|---|---|---|---|
| Sample No. | Composition | H (%)/F (%) | Film thickness (μm) | Composition | C or N (%) | O (%) | H (%)/F (%) | Film thickness (μm) |
| 17 | a-Si:H | 18/0 | 5.0 | a-SiC:H | 40 | 0 | 20/0 | 0.15 |
| 18 | a-Si:H | 18/0 | 5.0 | a-SiC:H | 40 | 0 | 20/0 | 0.15 |
| 19 | a-Si:H | 18/0 | 5.0 | a-SiC:H | 40 | 0 | 20/0 | 0.15 |
| 20 | a-Si:H | 18/0 | 5.0 | a-SiC:H | 40 | 0 | 20/0 | 0.15 |
| 21 | a-Si:H | 18/0 | 5.0 | a-SiC:H | 40 | 0 | 20/0 | 0.15 |
| 22 | a-Si:H | 18/0 | 5.0 | a-SiC:H | 40 | 0 | 20/0 | 0.15 |
| 23 | a-Si:H/F | 17/5 | 5.0 | a-SiC:H/F | 50 | 0 | 16/5 | 0.15 |
| 24 | a-Si:H/F | 17/5 | 5.0 | a-SiCO:H/F | 35 | 20 | 16/5 | 0.15 |
| 25 | a-Si:H/F | 17/5 | 5.0 | a-SiN:H/F | 50 | 0 | 17/5 | 0.15 |
| 26 | a-Si:H/F | 17/5 | 5.0 | a-SiNO:H/F | 35 | 20 | 17/5 | 0.15 |
| 27 | a-Si:H | 18/0 | 5.0 | a-SiC:H | 40 | 0 | 20/0 | 0.15 |
| 28 | a-Si:H | 18/0 | 5.0 | a-SiC:H | 40 | 0 | 20/0 | 0.15 |
| 29 | a-Si:H | 18/0 | 5.0 | a-SiC:H | 40 | 0 | 20/0 | 0.15 |
| 30 | a-Si:H | 18/0 | 5.0 | a-SiC:H | 40 | 0 | 20/0 | 0.15 |
| 31 | a-Si:H | 18/0 | 5.0 | a-SiC:H | 40 | 0 | 20/0 | 0.15 |
| 32 | a-Si:H | 18/0 | 5.0 | a-SiC:H | 40 | 0 | 20/0 | 0.15 |
| 33 | a-Si:H/F | 17/5 | 5.0 | a-SiC:H/F | 50 | 0 | 16/5 | 0.15 |
| 34 | a-Si:H/F | 17/5 | 5.0 | a-SiCO:H/F | 35 | 20 | 16/5 | 0.15 |

TABLE 2-continued

| | | | | | | | | | |
|---|---|---|---|---|---|---|---|---|---|
| 35 | a-Si:H/F | 17/5 | 5.0 | a-SiN:H/F | 50 | 0 | 17/5 | 0.15 |
| 36 | a-Si:H/F | 17/5 | 5.0 | a-SiNO:H/F | 35 | 20 | 17/5 | 0.15 |

| | Photoreceptor use temperature | | | | | | | |
|---|---|---|---|---|---|---|---|---|
| | 20° C. | | | | 50° C. | | | |
| Sample No. | Charged potential Vo (V) | Halving exposure quantity $E_{\frac{1}{2}}$ (lux · sec) | Residual potential $V_R$ (V) | Image quality 200,000 copies | Charged potential Vo (V) | Halving exposure quantity $E_{\frac{1}{2}}$ (lux · sec) | Residual potential $V_R$ (V) | Image quality 200,000 copies |
| 17 | +680 | 0.7 | 10 | ◎ | +610 | 0.7 | 10 | ○ |
| 18 | +710 | 0.8 | 20 | ◎ | +640 | 0.7 | 10 | ◎ |
| 19 | +740 | 0.8 | 30 | ◎ | +670 | 0.8 | 20 | ◎ |
| 20 | +770 | 0.9 | 40 | ○ | +690 | 0.8 | 30 | ◎ |
| 21 | +620 | 0.7 | 10 | ○ | +380 | 0.6 | 7 | X |
| 22 | +830 | 1.8 | 80 | X | +590 | 1.8 | 80 | X |
| 23 | +690 | 0.7 | 10 | ◎ | +620 | 0.7 | 10 | ◎ |
| 24 | +730 | 0.8 | 20 | ◎ | +660 | 0.7 | 10 | ◎ |
| 25 | +760 | 0.8 | 30 | ◎ | +680 | 0.8 | 30 | ◎ |
| 26 | +700 | 0.7 | 20 | ◎ | +630 | 0.7 | 20 | ◎ |
| 27 | +690 | 0.6 | 7 | ◎ | +600 | 0.6 | 7 | ○ |
| 28 | +700 | 0.7 | 15 | ◎ | +630 | 0.7 | 10 | ◎ |
| 29 | +750 | 0.8 | 25 | ◎ | +660 | 0.8 | 20 | ◎ |
| 30 | +780 | 0.9 | 45 | ○ | +630 | 0.8 | 35 | ◎ |
| 31 | +610 | 0.6 | 7 | ○ | +360 | 0.6 | 7 | X |
| 32 | +450 | 2.0 | 90 | X | +600 | 1.9 | 80 | X |
| 33 | +690 | 0.7 | 7 | ◎ | +610 | 0.7 | 10 | ◎ |
| 34 | +740 | 0.8 | 25 | ◎ | +670 | 0.8 | 10 | ◎ |
| 35 | +770 | 0.7 | 30 | ◎ | +670 | 0.7 | 25 | ◎ |
| 36 | +690 | 0.8 | 20 | ◎ | +620 | 0.7 | 25 | ◎ |

We claim:

1. A photoreceptor comprising a charge generation layer consisting essentially of at least one compound selected from the group consisting of amorphous hydrogenated silicon, amorphous fluorinated silicon and amorphous hydrofluorinated silicon; a charge transport layer formed on a lower surface of said charge generation layer and consisting essentially of at least one compound selected from the group consisting of amorphous hydrogenated silicon nitride, amorphous fluorinated silicon nitride, amorphous hydrofluorinated silicon nitride, amorphous hydrogenated silicon carbide, amorphous fluorinated silicon carbide and amorphous hydrofluorinated silicon carbide; a charge blocking layer; a surface modifying layer; and a substrate, wherein said charge transport layer contains (i) from 50 atomic ppm to 5 atomic % oxygen and (ii) from 5 atomic % to 30 atomic % of at least one element selected from carbon and nitrogen based on the total atoms of silicon, nitrogen and carbon and wherein the charge transport layer further contains at least one element of IIIa group of the periodic table in an amount up to 50 atomic ppm based on the total amount of silicon, nitrogen and carbon.

2. A photoreceptor of claim 1, wherein said charge transport layer contains oxygen within the range of from 50 atomic ppm to 500 atomic ppm based on the total atoms of silicon, nitrogen and carbon.

3. A photoreceptor of claim 1, wherein a charge blocking layer, which consists essentially of at least one compound selected from the group consisting of amorphous hydrogenated silicon nitride, amorphous fluorinated silicon nitride, amorphous hydrofluorinated silicon nitride, amorphous hydrogenated silicon carbide, amorphous fluorinated silicon carbide and amorphous hydrofluorinated silicon carbide and which contains elements of IIIa group of the periodic table within the range of from 100 atomic ppm to 5000 atomic ppm based on the total amount of silicon, nitrogen and carbon, is formed on the lower surface of said charge transport layer.

4. A photoreceptor of claim 3, wherein said charge blocking layer further contains oxygen within the range of from 50 atomic ppm to 5 atomic % based on the total atoms of silicon, nitrogen and carbon.

5. A photoreceptor of claim 4, wherein said charge transport layer contains boron doped by glow discharge decomposition under the condition that a flow rate of $B_2H_6/SiH_4$ is in the range of from 1 ppm to 50 ppm.

6. A photoreceptor of claim 3, wherein said charge blocking layer contains boron doped by glow discharge decomposition under the condition that a flow rate of $B_2H_6/SiH_4$ is in the range of from 100 ppm to 5,000 ppm, is formed on the lower surface of said charge transport layer.

7. A photoreceptor of claim 1, wherein said charge transport layer consist essentially of at least one compound selected from the group consisting of amorphous hydrogenated silicon nitride, amorphous fluorinated silicon nitride and amorphous hydrofluorinated silicon nitride, and the content of nitrogen of said charge transport layer is within the range of from 5 atomic % to 30 atomic % based on the total amount of silicon and nitrogen.

8. A photoreceptor of claim 1, wherein said charge transport layer consists essentially of at least one compounds selected from the group consisting of amorphous hydrogenated silicon carbide, amorphous fluorinated silicon carbide and amorphous hydrofluorinated silicon carbide, and the content of carbon of said charge transport layer is within the range of from 5 atomic % to 30 atomic % based on the total amount of silicon and carbon.

9. A photoreceptor of claim 1, wherein a surface modifying layer which consists essentially of at least one compound selected from the group consisting of amorphous hydrogenated silicon nitride, amorphous fluorinated silicon nitride and amorphous hydrofluorinated silicon nitride, and the content of nitrogen is within the range of from 10 atomic % to 70 atomic % based on the total amount of silicon and nitrogen, is formed on the upper surface of said charge generation layer.

10. A photoreceptor of claim 9, wherein said surface modifying layer further contains oxygen within the range of from 1 atomic % to 50 atomic % based on the total amount of silicon, nitrogen and oxygen.

11. A photoreceptor of claim 1, wherein a surface modifying layer which consists essentially of at least one compound selected from the group consisting of amorphous hydrogenated silicon carbide, amorphous fluorinated silicon carbide and amorphous hydrofluorinated silicon carbide, and the content of carbon is within the range of from 10 atomic % to 70 atomic % based on the total amount of silicon and carbon, is formed on the upper surface of said charge generation layer.

12. A photoreceptor of claim 11, wherein said surface modifying layer further contains oxygen within the range of from 1 atomic % to 50 atomic % based on the total amount of silicon, carbon and oxygen.

13. A photoreceptor of claim 1, wherein said charge generation layer has the thickness within the range of from 1 μm to 10 μm.

14. A photoreceptor of claim 1, wherein said charge transport layer has the thickness within the range of from 10 μm to 30 μm.

15. A photoreceptor of claim 9, wherein said surface modifying layer has the thickness within the range of from 400 Å to 5,000 Å.

16. A photoreceptor of claim 3, wherein said charge blocking layer has the thickness within the range of from 400 Å to 2 μm.

17. A photoreceptor of claim 1, wherein the contents of hydrogen of said charge generation layer and said charge transport layer are within the range of from 1 atomic % to 40 atomic % based on the total amount of silicon and hydrogen.

18. A photoreceptor of claim 3, wherein the content of hydrogen of said charge blocking layer is within the range of from 1 atomic % to 40 atomic % based on the total amount of silicon and hydrogen.

19. A photoreceptor of claim 9, wherein the content of hydrogen of said surface modifying layer is within the range of from 1 atomic % to 40 atomic % based on the total amount of silicon and hydrogen.

20. A photoreceptor of claim 1, wherein the contents of fluorine of said charge generation layer and said charge transport layer are within the range of from 0.01 atomic % to 20 atomic % based on the total amount of silicon and fluorine.

21. A photoreceptor of claim 3, wherein the content of fluorine of said charge blocking layer is within the range of from 0.01 atomic % to 20 atomic % based on the total amount of silicon and fluorine.

22. A photoreceptor of claim 9, wherein the content of fluorine of said surface modifying layer is within the range of from 0.01 atomic % to 20 atomic % based on the total amount of silicon and fluorine.

23. A photoreceptor of claim 11, wherein said surface modifying layer has the thickness within the range of from 400 Å to 5,000 Å.

24. A photoreceptor of claim 11, wherein the content of hydrogen of said surface modifying layer is within the range of from 1 atomic % to 40 atomic % based on the total amount of silicon and hydrogen.

25. A photoreceptor of claim 11, wherein the content of fluorine of said surface modifying layer is within the range of from 0.01 atomic % to 20 atomic % based on the total amount of silicon and fluorine.

26. A photoreceptor of claim 1 wherein said charge transport layer contains 9 atomic % of carbon or nitrogen.

27. A photoreceptor of claim 1 wherein said charge transport layer contains 12 atomic % of carbon or nitrogen.

28. A photoreceptor of claim 1 wherein said charge transport layer contains 15 atomic % of carbon or nitrogen.

29. A photoreceptor of claim 28 wherein said charge transport layer contains 15% carbon.

30. A photoreceptor comprising a charge generation layer consisting essentially of at least one compound selected from the group consisting of amorphous hydrogenated silicon, amorphous fluorinated silicon and amorphous hydrofluorinated silicon;

a charge transport layer formed on a lower surface of said charge generation layer and consisting essentially of at least one compound selected from the group consisting of amorphous hydrogenated silicon nitride, amorphous fluorinated silicon nitride, amorphous hydrogenated silicon carbide and amorphous fluorinated silicon carbide;

a charge blocking layer;

a surface modifying layer; and a substrate, wherein said charge transport layer contains (i) from 50 atomic ppm to 5 atomic % oxygen and (ii) from 5 atomic % to 30 atomic % of at lest one element selected form carbon and nitrogen based on the total atoms of silicon, nitrogen and carbon and wherein the charge transport layer further contains at least one element of IIIa group of the periodic table in an amount up to 50 atomic ppm based on the total amount of silicon, nitrogen and carbon.

31. The photoreceptor of claim 30 wherein said surface modifying layer has the thickness within the range of from 400 Å to 5,000 Å;

said charge generation layer has a thickness within the range of from 1 μm to 10 μm;

said charge transport layer has the thickness within the range of from 10 μm to 30 μm; and said photoreceptor further comprises a charge blocking layer of 400 Å to 2 μm thickness, formed on the lower surface of said charge transport layer and which consists essentially of at least one compound selected from the group consisting of amorphous hydrogenated silicon nitride, amorphous fluorinated silicon nitride, amorphous hydrogenated silicon carbide and amorphous fluorinated silicon carbide; oxygen within the range of from 50 ppm to 5% based on the total atoms of silicon, nitrogen and carbon; and doped with 100 to 5000 at ppm of an element belonging to the group IIIa of the periodic table.

32. The photoreceptor of claim 31 wherein said surface modifying layer has a thickness of 0.15 to 5 μm and consists of amorphous hydrogenated silicon carbide;

said charge generation layer has a thickness of 1 to 5 μm and consists of amorphous hydrogenated silicon;

said charge transport layer has a thickness of 10–15 μm and consists essentially of amorphous hydrogenated silicon carbide doped with boron as said group IIIa element;

said charge blocking layer has a thickness of 400 Å to 2 μm and consists essentially of amorphous hydrogenated silicon carbide doped with boron as said group IIIa element.

* * * * *